US007294004B1

(12) United States Patent
Pineda et al.

(10) Patent No.: US 7,294,004 B1
(45) Date of Patent: Nov. 13, 2007

(54) LATCHING SYSTEM FOR SMALL-FORM PLUGGABLE DEVICE

(75) Inventors: June B. Pineda, San Jose, CA (US); Donald A. Blackwell, Saratoga, CA (US)

(73) Assignee: Finisar Corporation, Sunnyvale, CA (US)

( * ) Notice: Subject to any disclaimer, the term of this patent is extended or adjusted under 35 U.S.C. 154(b) by 0 days.

(21) Appl. No.: 11/585,553

(22) Filed: Oct. 23, 2006

(51) Int. Cl.
*H01R 13/62* (2006.01)

(52) U.S. Cl. ..... 439/160; 439/452

(58) Field of Classification Search ..... 439/160, 439/352, 353
See application file for complete search history.

(56) References Cited

U.S. PATENT DOCUMENTS 6,434,015 B1 * 8/2002 Hwang ..... 361/754
6,517,382 B2 * 2/2003 Flickinger et al. ..... 439/607
6,570,768 B2 * 5/2003 Medina ..... 361/747
6,780,045 B2 * 8/2004 Shuey et al. ..... 439/489
6,916,196 B2 7/2005 Long et al.
7,212,410 B2 * 5/2007 Larson ..... 361/726
2002/0142649 A1 * 10/2002 Baugh et al. ..... 439/532

* cited by examiner

*Primary Examiner*—Hae Moon Hyeon
(74) *Attorney, Agent, or Firm*—North Weber & Baugh LLP

(57) ABSTRACT

A latching system for a small from pluggable receptacle that uses a securement recess in a resilient catch to secure a casing in the receptacle includes on a lateral surface of the casing a securement tang that is captured in the securement recess and a release trigger on a surface of the casing located outside the receptacle. The release trigger includes a mounting bridge defining a guide passage oriented toward the securement tang and an actuator slidably disposed in the guide passage for movement in alignment with the securement tang. A catch deflector extending centrally from the actuator toward the securement tang has a free end configured to displace the catch away from the casing when cause by an operator to move toward the securement tang.

20 Claims, 6 Drawing Sheets

LATCHING SYSTEM FOR SMALL-FORM PLUGGABLE DEVICE

BACKGROUND

A. Technical Field

The present invention relates generally to small-form pluggable devices, and more particularly, to latching systems, and components therein, used to releasably retain a module in a small-form pluggable socket.

B. Background of the Invention

Complex electrical and optical computer processing systems utilize a modular approach that allows system subcomponents to efficiently function within the system. For example, small form pluggable receptacles are designed to receive and retain configured plugs that carry various groupings of subcomponents of the system.

A module is inserted into a corresponding small-form pluggable receptacle, the interconnections affected with the corresponding overall system are maintained through the retention of the module in the receptacle by any number of mechanical latching systems. The configuration of such small-form pluggable latching systems is often specified by standards developed in each type of industry in which small-form pluggable modular interconnections find utility.

The retention of a module in a small-form pluggable receptacle cannot be permanent, as it is necessary to remove the module from the receptacle in which it is inserted. Small-form pluggable latching systems are, therefore, generally selectively releasable, and trigger mechanisms for releasing such systems are diverse. A trigger mechanism design for releasing an associated latching system may be constrained by various factors including the confined conditions in which the latching systems are installed, and the degree of easy accessibility required to each related release trigger mechanisms. Additionally, mechanical simplicity, inexpensive manufacture, and ease and intuitiveness of operation are desirable design qualities in small-form pluggable latching system release triggers.

BRIEF DESCRIPTION OF THE DRAWINGS

Reference will be made to embodiments of the invention, examples of which may be illustrated in the accompanying figures. These figures are intended to be illustrative, not limiting. Although the invention is generally described in the context of these embodiments, it should be understood that it is not intended to limit the scope of the invention to these particular embodiments.

DETAILED DESCRIPTION OF THE PREFERRED EMBODIMENTS

In the following description of the inventive technology and environmental structures commonly interacting therewith, for the purpose of explanation, specific details are set forth in order to provide an optimum understanding. It will be apparent, however, that the inventive technology may be implemented without the inclusion of all or even any such details. For example, illustrations of the latching system positioned on a board are meant to provide information as to one environment in which the invention may operate. Only selected embodiments of the inventive technology are described herein, but any may be incorporated into a number of different devices and systems without departing from teachings of the present invention. Structures and devices shown in the figures thus illustrate exemplary embodiments of the inventive technology, and further illustrations of additional such exemplary forms of those structures have been foregone as possibly serving merely to obscure a clear disclosure of the inventive technology.

Reference in the specification to "one embodiment" or "an embodiment" means that a particular feature, structure, characteristic, or function described in connection with the embodiment is included in at least one embodiment of the invention. The appearances of the phrase "in one embodiment" in various places in the specification do not necessarily all refer to the same embodiment.

Figure 1:
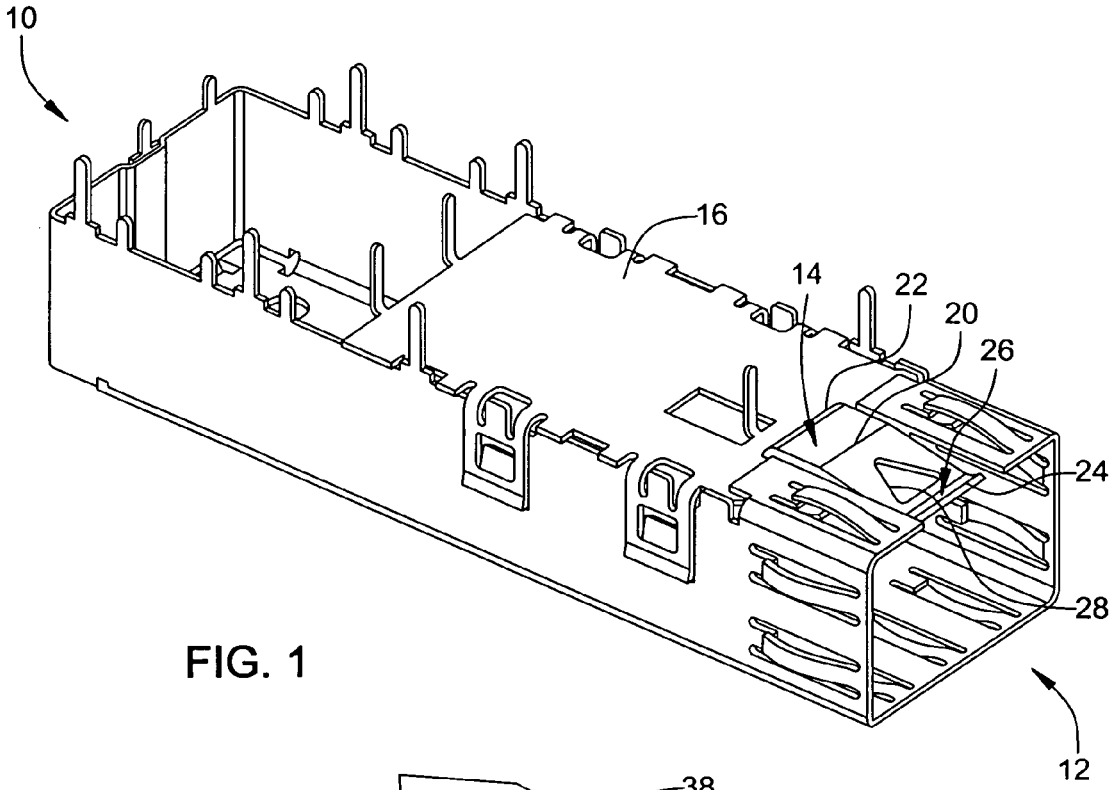
FIG. 1 is a perspective view of a typical small-form pluggable receptacle.

FIG. 1 illustrates an exemplary small-form pluggable receptacle 10 that receives an electrical or optical module according to various embodiments of the invention. As shown in FIG. 1, receptacle 10 is a rigid, hollow container having an open end 12 designed according to applicable small-form pluggable specifications to receive and retain therein a plug. The module may comprise a casing that carries subcomponents of the system with which receptacle 10 is associated. In so doing, receptacle 10 functions as a socket for such a casing.

At the threshold of open end 12, receptacle 10 is provided with a resilient catch 14 that projects at open end 12 of receptacle 10 from a surface 16 of receptacle 10 that is uppermost in the perspective view presented in FIG. 1.

Catch 14 is a generally planar structure that is deformed slightly inwardly in the direction of open end 12 of receptacle 10 commencing at a bend 20 at some distance from the attached end 22 of catch 14 that is secured to surface 16 of receptacle 10. The free end 24 of the catch 14 terminates in a curved lip 26 that is turned away from the open end 12 of the receptacle 10 in a direction opposite to that imparted to the catch 14 between the bend 20 and the lip 26. Catch 14 is proportioned so that a force applied against lip 26 will deform catch 14 and push catch 14 away from the open end 12. Upon the removal of such a deforming force, catch 14 will return to an undeformed condition by resilling back toward open end 12 of receptacle 10 into the latching position of catch 14 that is illustrated in FIG. 1.

Formed through catch 14 between bend 20 and lip 26 is a securement aperture 28 sized and positioned as to be capable of receiving and capturing therein a cooperating securement projection, or tang, that is rigidly attached to a lateral surface of the casing.

During the insertion into the open end 12 of receptacle 10 of a casing bearing a securement tang keyed to securement recess 28, the securement tang will initially encounter lip 26 at free end 24 of catch 14. Further advancement of the casing into receptacle 10 causes the securement tang to urge catch 14 progressively away from the open end 12 and the casing. The continuation of this process eventually enables the securement tang to reach and enter securement recess 28. Thereupon, the securement tang becomes captured in the securement recess 28 due to the resilling of catch 14 toward the casing into the latching position of catch 14 shown in FIG. 1.

Figure 2:
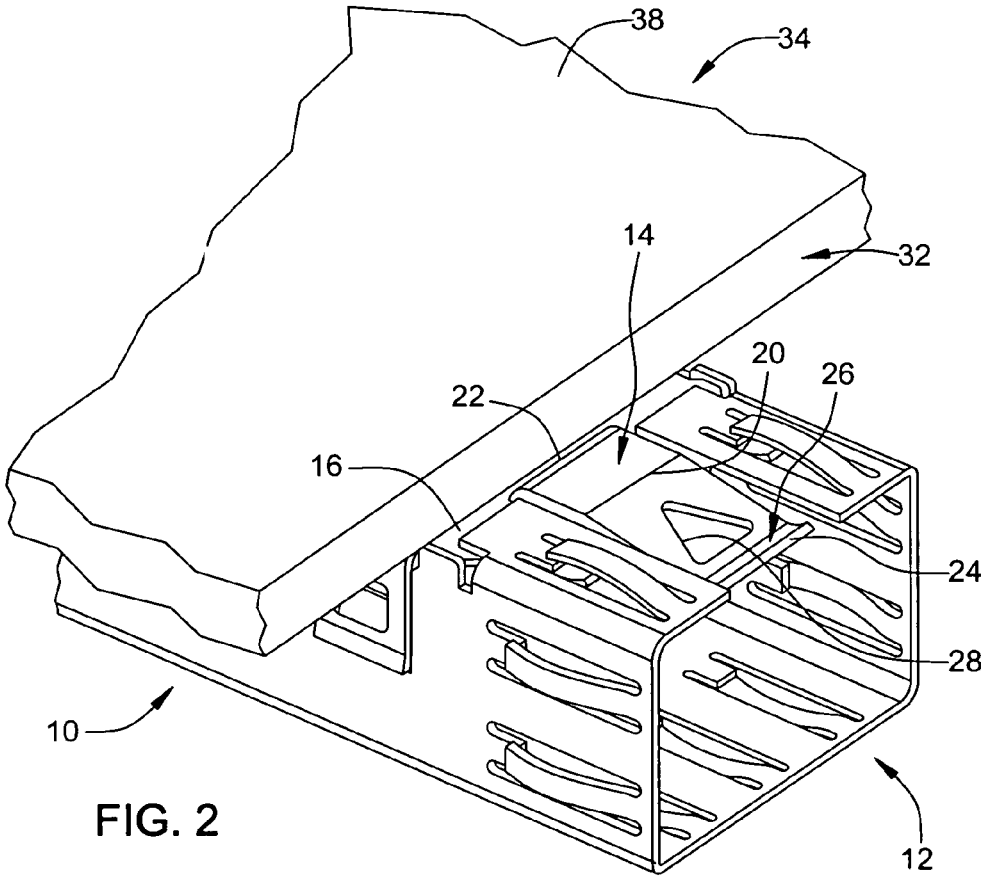
FIG. 2 is a perspective view of a typical small form pluggable receptacle showing a threshold of an open end of the receptacle.

In FIG. 2, receptacle 10 is shown secured at an edge 32 of a planar support board 34 with open end 12 of receptacle 10 projecting outwardly from edge 32.

Figure 3:
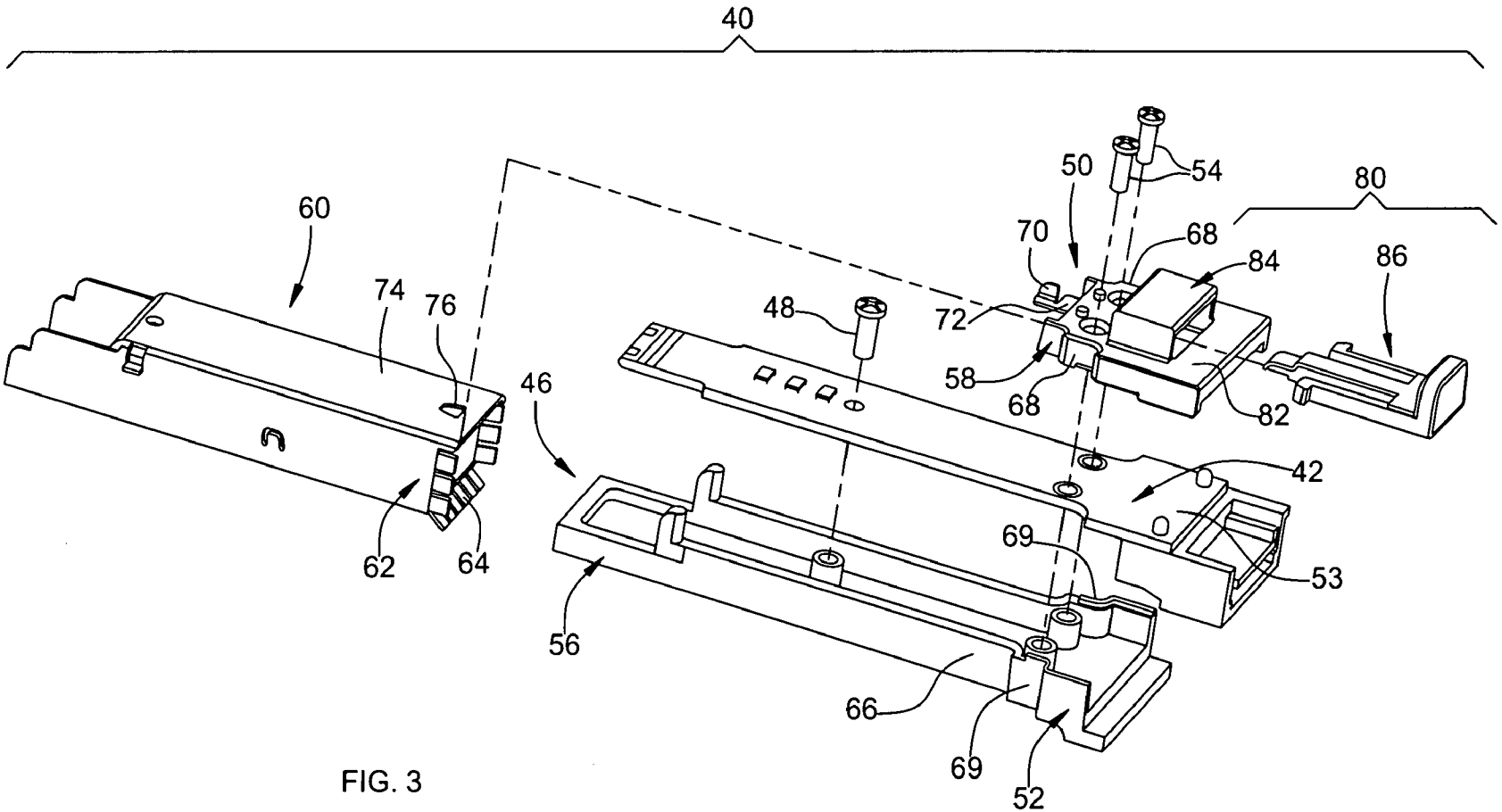
FIG. 3 is an exploded perspective view of disassembled components of a casing that may be received into a small-form pluggable receptacle according to various embodiments of the invention.

FIG. 3 illustrates a perspective view of the disassembled components of a casing 40 for electrical or optical system subcomponents 42 that function in the larger overall system with receptacle 10. The casing 40 may be a module of the type intended to be receivable into small-form pluggable receptacle 10. Furthermore, by incorporating teachings of the present invention, casing 40 is selectively releasable from the small-form pluggable latching system that operates to retain casing 40 in receptacle 10. In one embodiment of the invention, casing 40 includes a base 46 against which system subcomponents 42 are supported and secured with an attachment screw 48. The casing 40 also includes a cover 50 that, being shorter than base 46, is fitted against base 46 in alignment with the terminus of a first end 52 thereof. An end 53 of system subcomponents 42 is sandwiched in this assembly between cover 50 and first end 52 of base 46. Cover 50 and first end 52 of base 46 are then secured together by paired screws 54. Alternatively, cover 50 may be secured to base 46 using an adhesive.

Figure 5A:
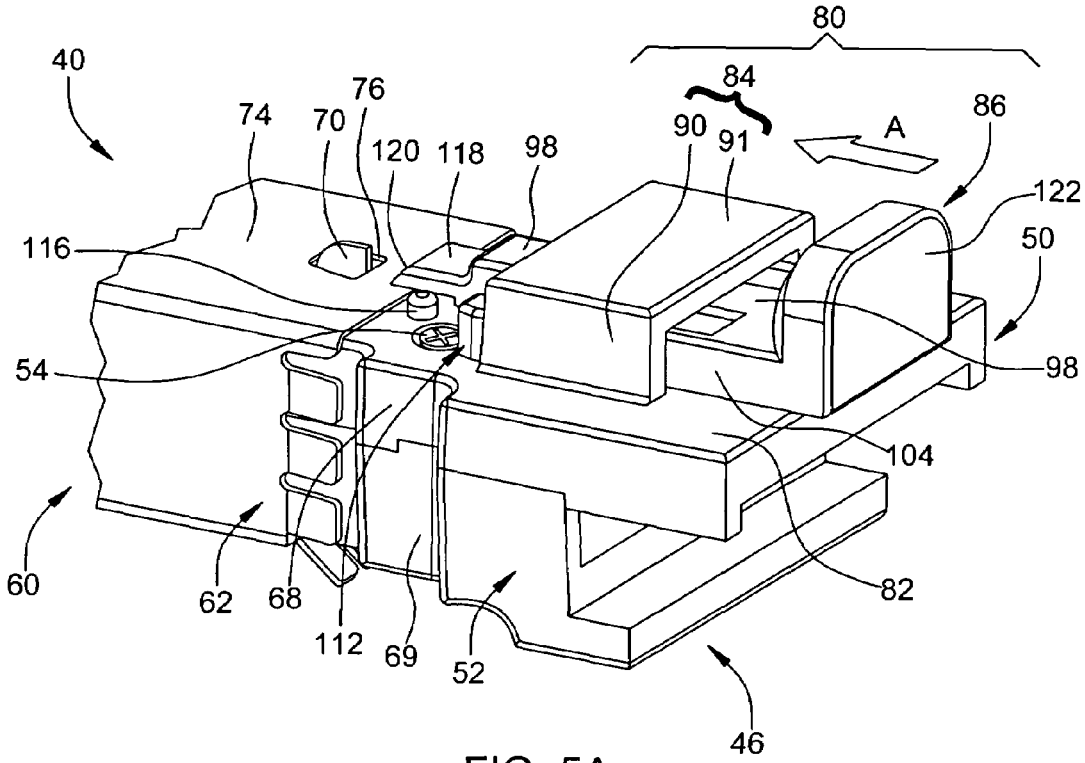
FIG. 5A is a perspective view of an end of an assembled casing in an inactive trigger position according to various embodiments of the invention.
Figure 5B:
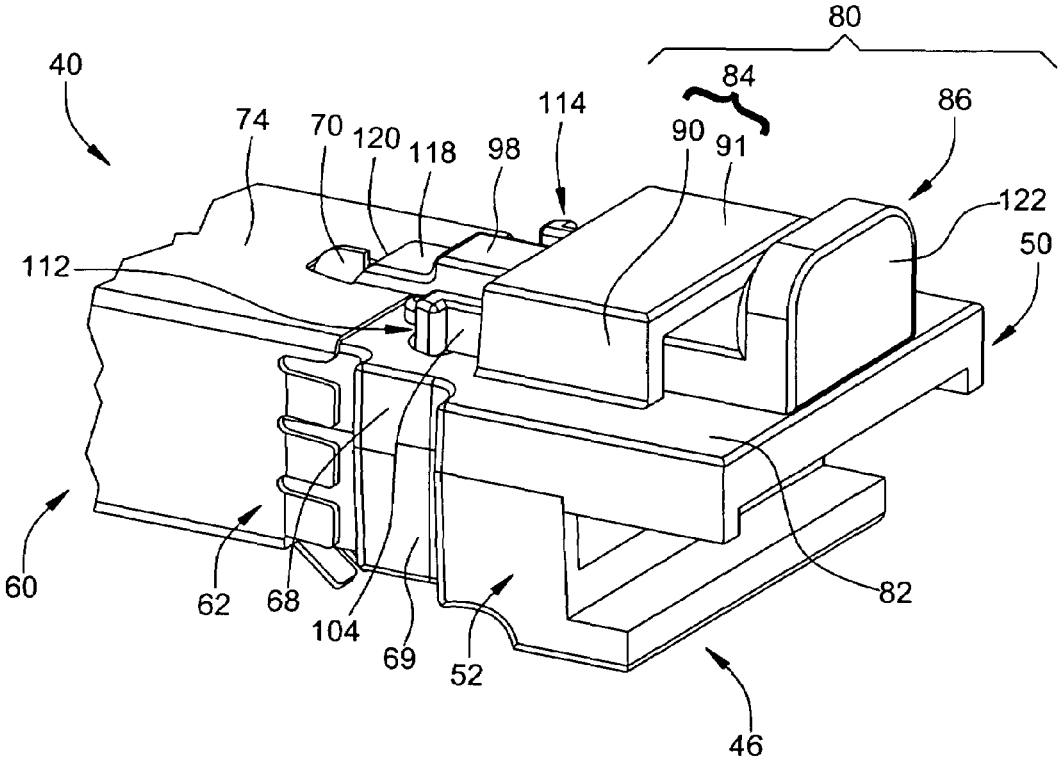
FIG. 5B is a perspective view of an end of an assembled casing in a releasing position according to various embodiments of the invention.

Once interconnected, the second end 56 of base 46, the end of system subcomponents 42 remote from cover 50, and a narrow end 58 of cover 50 are inserted into an open end 62 of a casing shell 60. The second end 56 of base 46 and a major portion of the length of system subcomponents 42 thereby become housed in and protected by casing shell 60. The resulting assembled condition of casing 40 is depicted in FIGS. 5A and 5B. In that assembled condition of casing 40, the threshold 64 of open end 62 of casing shell 60 is filled by narrow end 58 of cover 50 and an opposed portion 66 of the length of base 46. Outside of casing shell 60, cover 50 enlarges relative to narrow end 58 thereof in a neck section 68. Correspondingly, outside of casing shell 60, base 46 enlarges laterally relative to portion 66 thereof in a similar neck section 69.

Another component of casing 40 is a securement tang 70. Securement tang 70 is connected to the narrow end 58 of cover 50 by a tang platform 72. Generally, securement tang 70 may be made from a metallic material. Securement tang 70 may, therefore, be integral with cover 50, if cover 50 is also made of a metallic material. Alternatively, cover 50 may be injection molded about tang platform 72.

When narrow end 58 of cover 50 is entered into the open end 62 of casing shell 60, tang platform 72 also becomes enclosed in casing shell 60. The securement tang 70 extends through a tang aperture 76 formed through a corresponding lateral side 74 of casing shell 60. In the assembled condition of casing 40 shown in FIGS. 5A and 5B, securement tang 70 is an upstanding structure that projects outwardly from lateral side 74 of casing shell 60. The position of tang aperture 76 is so selected that securement tang 70 projects from a lateral surface of the assembled casing 40. During insertion of casing 40 into receptacle 10, securement tang 70 urges catch 14 away from casing 40, until securement tang 70 reaches securement recess 28. Securement tang 70 is captured in securement recess 28 due to the resilling of catch 14 toward casing 40 into the latching position of catch 14.

As it may be necessary to remove the casing 40 from receptacle 10 to repair or replace system subcomponents 42, the casing 40 is provided with a release trigger 80 that enables an operator to free securement tang 70 from securement recess 28 of catch 14, and withdraw the casing 40 from receptacle 10. One embodiment of the release trigger 80 includes structures that are upstanding from or mounted to a lateral trigger mount surface 82 of cover 50, which is located outside of receptacle 10 when the casing 40 is received and securement tang 70 is captured in securement recess 28 of catch 14.

Figure 4:
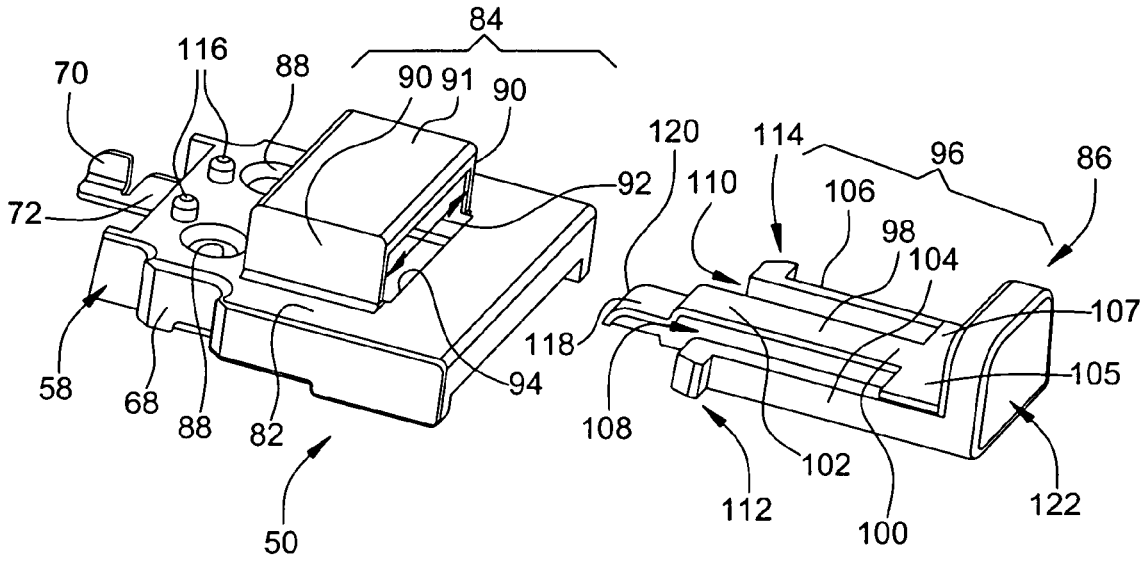
FIG. 4 is an exploded perspective view of a selected pair of the casing subcomponents according to various embodiments of the invention.

Referring to FIG. 4, the securement tang 70 on tang platform 72 can be seen projecting from the narrow end 58 of cover 50. Formed through the trigger mount surface 82 of cover 50 are apertures 88 designed to receive paired screws 54 when the components of casing 40 are assembled and attached together. A mounting bridge 84 includes a pair of planar parallel uprights 90 that project perpendicularly from trigger mount surface 82 and a flat rectangular span 91 supported between the ends of uprights 84. The trigger mount surface 82 and the interior of mounting bridge 84 define openings 92 that are at the opposite ends of a guide passageway beneath mounting bridge 84. Only one such opening 92 is actually visible in FIG. 4, as the other opening 92 is obscured in FIG. 4 by mounting bridge 84. In the embodiment shown in FIG. 4, a long side of each of the openings 92 coincides with trigger mount surface 82.

A window 94 is formed through trigger mount surface 82 of cover 50 below mounting bridge 84. Window 84 may be congruent with the lower side of span 91 of mounting bridge 84. Then window 94 underlies the entirety of span 91, and the manufacture of cover 50 in an injection molding processes is simplified by permitting the use of a shut-off-front-and-back molding plug to from the portion of cover 50 that is intended to become mounting bridge 84.

Actuator 86 is configured to be slidably disposed in the guide passage beneath mounting bridge 84 and to be capable in that disposition of engaging with securement tang 70. As seen in FIG. 4, actuator body 96 includes a centrally disposed elongated footing 98 having a proximal end 100 and a distal end 102, a resilient first stabilization leg 104 secured to a first side 105 of proximal end 100 of footing 98. A similar resilient second stabilization leg 106 is secured to a second side 107 of proximal end 100 of footing 98.

The first stabilization leg 104 extends from first side 105 of proximal end 100 footing 98 and defines a first slot 108 having an open end adjacent to distal end 102 of footing 98. Similarly, the second stabilization leg 106 extends from second side 107 of proximal end 100 of footing 98 and defines a second slot 110 having an open end adjacent to distal end 102 of footing 98. A first actuator retention barb 112 extends from the first stabilization leg 104 away from first slot 108 at a position remote from proximal end 100 of footing 98. A second actuator retention barb 114 extends from the second stabilization leg 106 away from second slot 110 at a position remote from proximal end 100 of footing 98.

To enter actuator 86 into the guide passage beneath mounting bridge 84, the first stabilization leg 104 and the second stabilization leg 106 are deformed by an assembler inwardly toward footing 98 a sufficient amount to permit first actuator retention barb 112 and second actuator retention barb 114 to pass through the guide passage from one side of mounting bridge 84 to the other. Once deforming forces are removed, first stabilization leg 104 and second stabilization leg 106 engage uprights 84 of mounting bridge 84, while first actuator retention barb 112 and second actuator retention barb 114 preclude the withdrawal of actuator 86 from the guide passage beneath mounting bridge 84.

During reciprocating sliding movement of actuator 86 in the guide passage beneath mounting bridge 84, footing 98 is laterally constrained between a pair of upstanding stabilization posts 116 on trigger mount surface 82. Projecting from the distal end 102 of footing 98 is a catch deflector 118 that is aligned with the guide passage beneath mounting bridge 84. The free end 120 of the catch deflector 118 is configured to release securement tang 70 from securement recess 28 by displacing catch 14 away from the casing 40 and out of the latching position of catch 14. In the illustrated embodiment, free end 120 is beveled toward actuator body 96 from the side of catch deflector 118 closest to trigger mount surface 82.

To facilitate the operation of release trigger 80, actuator 86 may optionally include an enlarged handle 122 at the end of actuator body 96. In an alternate embodiment of release trigger 80 not illustrated herein, it may be desirable that in the releasing position of actuator 86, a portion of handle 122 abuts the edge of mounting bridge 84 remote from securement tang 70. Then cooperating keying structures formed on the portion of handle 122 and the edge of mounting bridge 84 will advantageously insure the proper alignment of the components of release trigger 80 in the releasing position of actuator 86.

FIGS. 5A and 5B together depict the relative positions of various components of casing 40 at the extremes of the reciprocating sliding motion of actuator 86 of release trigger 80 in the guide passage beneath mounting bridge 84.

In FIG. 5A, the actuator 86 has been withdrawn away from securement tang 70 into the inactive position of release trigger 80. The first actuator retention barb 112 is seen to engage the edge of an upright 90 of mounting bridge 84, thus preventing further motion of actuator 86 away from securement tang 70. The distance of free end 120 of catch deflector 118 from securement tang 70 is thus maximized.

Movement of actuator 86 by an operator in the direction indicated by an arrow A in FIG. 5A will bring actuator 86 into the releasing position of release trigger 80, which is shown in FIG. 5B. There, free end 120 of catch deflector 118 is in close proximity to securement tang 70. As a result, free end 120 of catch deflector 118 will displace away from casing 40 any securement catch, such as catch 14, which might be capturing securement tang 70.

Figure 6A:
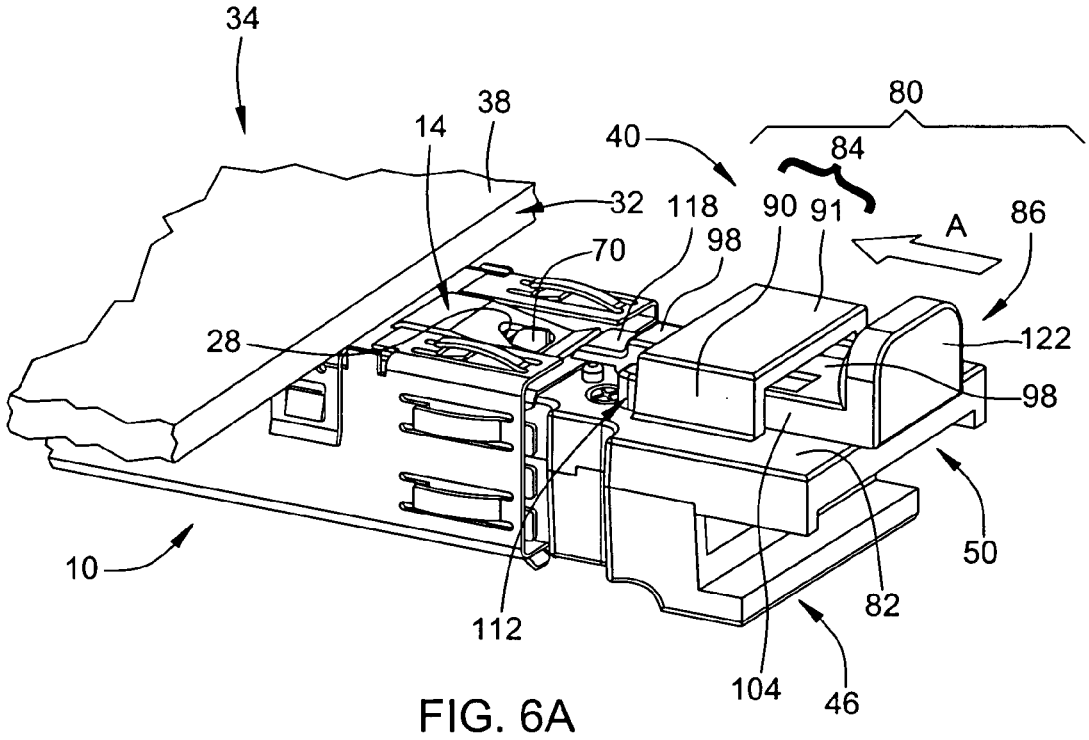
FIG. 6A is a perspective view of a receptacle of a latching system and latching system release trigger of a casing in an inactive position according to various embodiments of the invention.
Figure 6B:
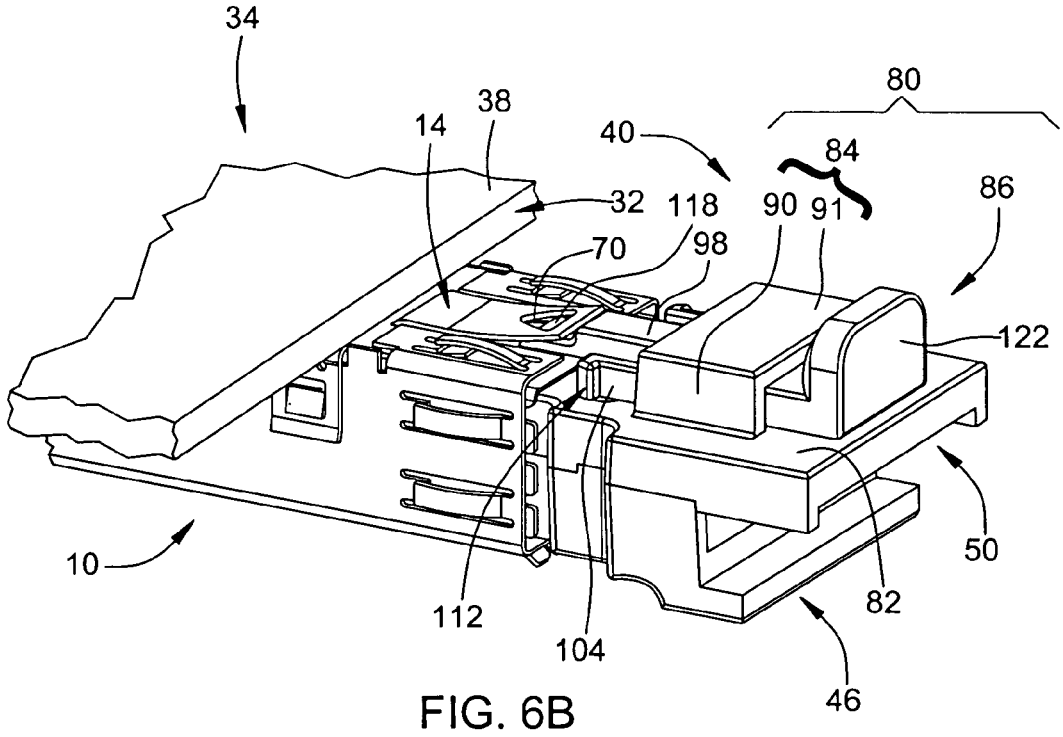
FIG. 6B is a perspective view of a receptacle of a latching system and latching system release trigger of a casing in a releasing position according to various embodiments of the invention.
Figure 6C:
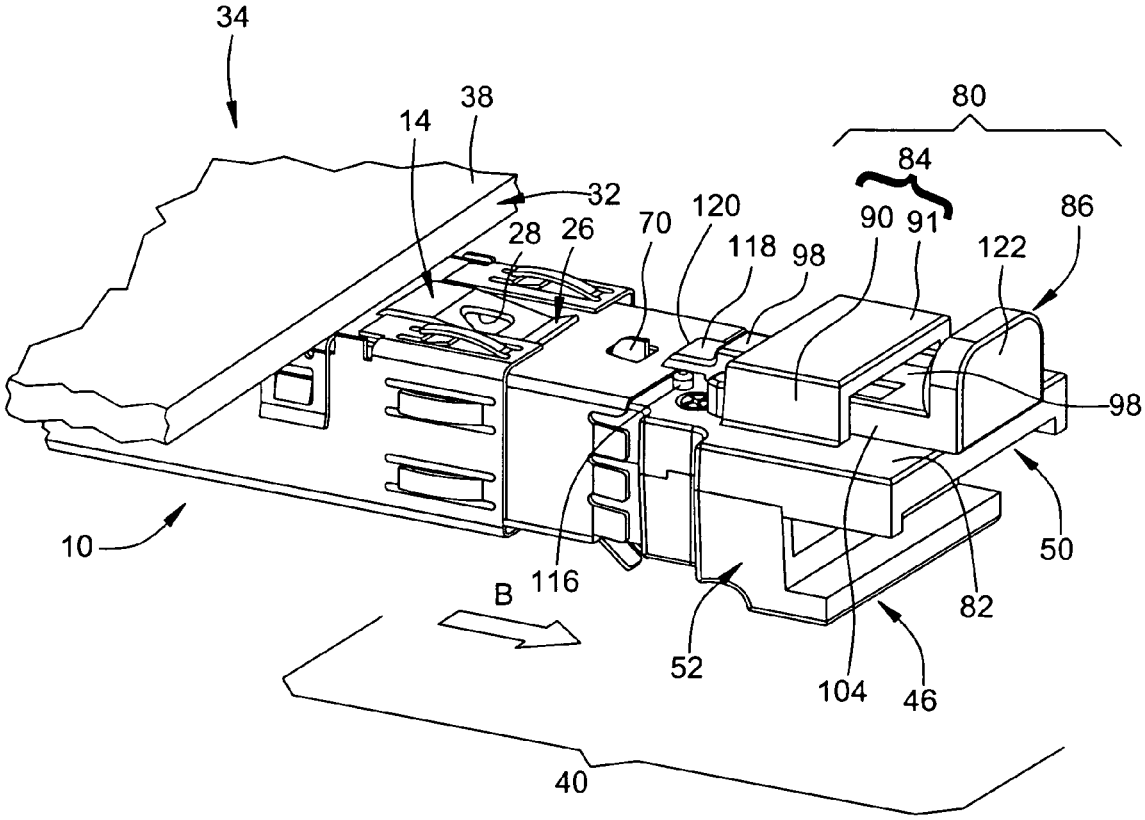
FIG. 6C is a perspective view of the structures shown in FIGS. 6A and 6B with the illustrated casing being withdrawn from the illustrated receptacle following the movement the latching system release trigger of the casing into the releasing position thereof shown in FIG. 6B.

FIGS. 6A-6C depict the effects of the operation of release trigger 80 on various components of a latching system for a small from receptacle, such as the receptacle 10.

In FIG. 6A, the casing 40 has been advanced sufficiently into open end 12 of receptacle 10 that securement tang 70 on casing 40 has urged catch 14 on receptacle 10 away from casing 40 and entered securement recess 28 in catch 14. The components of release trigger 80 are in the inactive position thereof with actuator 86 remote from securement tang 70.

In FIG. 6B, the actuator 86 has been advanced by an operator in the direction indicated by arrow A in FIG. 6A, bring actuator 86 into the releasing position of release trigger 80 with free end 120 of catch deflector 118 being in close proximity to securement tang 70. As a result, free end 120 of catch deflector 118 has displaced catch 14 away from casing 40 sufficiently to free securement tang 70 from securement recess 28 and catch 14.

Consequently, as depicted in FIG. 6C, casing 40 may be withdrawn from receptacle 10 in the direction indicated by an arrow B therein to repair or replace system components carried in casing 40.

The foregoing description of the invention has been described for purposes of clarity and understanding. It is not intended to limit the invention to the precise form disclosed. Various modifications may be possible within the scope and equivalence of the appended claims.

What is claimed is:

1. A release trigger for a module retained in a receptacle, the release trigger comprising:

a mounting bridge, upstanding from a lateral trigger mount surface on the module located outside of the receptacle when a securement tang on the module is captured in a securement recess in a resilient catch on the receptacle, the trigger mount surface and the interior of the mounting bridge at each edge thereof defining openings at opposite ends of a guide passageway beneath the mounting bridge oriented toward the securement tang; and an actuator slidably disposed in the guide passageway and being capable of engaging in reciprocating movement in alignment with the securement tang, the actuator comprising:

(i) an actuator body substantially filling the guide passageway during movement of the actuator; and (ii) a catch deflector projecting from the actuator body toward the securement tang in alignment with the guide passageway, the catch deflector having a free end remote from the actuator body being so configured as to release the securement tang from the securement recess by displacing the catch away from the module and out of the latching position, when the actuator is caused by an operator of the trigger to move toward the securement tang into a releasing position of the actuator;

a centrally disposed footing having a proximal end and a distal end, the catch deflector projecting toward the securement tang from the distal end of the footing in alignment with the guide passageway;

a resilient first stabilization leg secured at an end thereof to a first side of the proximal end of the footing, the first stabilization leg extending generally parallel to the footing, thereby to define between the footing and the first stabilization leg a first slot with an open end adjacent the distal end of the footing; and a resilient second stabilization leg secured at an end thereof to a second side of the proximal end of the footing, the second stabilization leg extending generally parallel to the footing, thereby to define between the footing and the second stabilization leg a second slot with an open end adjacent the distal end of the footing.

2. The release trigger as recited in claim 1, wherein the openings at the opposite ends of the guide passage are congruent.

3. The release trigger as recited in claim 2, wherein:

each of the openings at the opposite ends of the guide passage assumes the shape of a rectangle; and a long side of the rectangle coincides with the trigger mount surface of the module.

4. The release trigger as recited in claim 1 wherein the actuator further comprises:

(i) a first actuator retention barb extending from the first stabilization leg away from the first slot at a position remote from the proximal end of the footing; and (ii) a second actuator retention barb extending from the second stabilization leg away from the second slot at a position remote from the proximal end of the footing.

5. The release trigger as recited in claim 1, wherein a window is formed in the trigger mount surface beneath the mounting bridge.

6. The release trigger as recited in claim 1, wherein the actuator further comprises an enlarged handle at the end of the actuator body remote from the catch deflector.

7. The release trigger as recited in claim 6, wherein:

a portion of the handle abuts the edge of the bridge remote from the securement tang, when the actuator is in the releasing position thereof; and cooperating keying structures are formed, respectively, on the portion of the handle and on the edge of the bridge so abutted.

8. The release trigger as recited in claim 1, wherein the free end of the catch deflector is beveled toward the actuator body from the side of the catch deflector adjacent the trigger mount surface.

9. A casing comprising:

a base upon which system subcomponents are supported;

a cover secured to an end of the base, the cover and the base substantially filling the threshold of a receptacle when the casing is received therein;

an upstanding securement tang so interconnected to the cover that during advancement of the casing into the receptacle, the securement tang urges a resilient catch on the receptacle away from the casing to enter a securement recess in the catch, and the securement tang becoming captured in the securement recess by the resilling of the catch toward the casing into a latching position of the catch;

a mounting bridge upstanding from a lateral trigger mount surface on the cover located outside of the receptacle when the securement tang is captured in the securement recess, the trigger mount surface and the interior of the mounting bridge at each edge thereof defining congruent openings at opposite ends of a guide passageway beneath the mounting bridge oriented toward the securement tang;

a window formed through the cover beneath the entirety of the span of the mounting bridge; and an actuator slidably disposed in the guide passageway and being capable of engaging in reciprocating movement in alignment with the securement tang, the actuator comprising:

(i) an actuator body substantially filling the guide passageway during movement of the actuator; and (ii) a catch deflector projecting from the actuator body toward the securement tang, the catch deflector having a free end remote from the actuator body so configured as to release the securement tang from the securement recess by displacing the catch away from the casing and out of the latching position, when the actuator is caused by an operator to move toward the securement tang into a releasing position of the actuator.

10. The casing as recited in claim 9, wherein the actuator body comprises:

a footing having a proximal end and a distal end, the catch deflector projecting toward the securement tang from the distal end of the footing in alignment with the guide passageway;

a resilient first stabilization leg secured at an end thereof to a side of the proximal end of the footing, the first stabilization leg extending generally parallel to the footing, thereby to define between the footing and the first stabilization leg a first slot with an open end adjacent the distal end of the footing; and a resilient second stabilization leg secured at an end thereof to a second side of the proximal end of the footing, the second stabilization leg extending generally parallel to the footing, thereby to define between the footing and the second stabilization leg a second slot with an open end adjacent the distal end of the footing.

11. The casing as recited in claim 10, further comprising:

a first stabilization post upstanding from the trigger mount surface and slidably received in the first slot; and a second stabilization post upstanding from the trigger mount surface and slidably received in the second slot.

12. The casing as recited in claim 10, wherein the height of the transverse cross section of the catch deflector above the trigger mount surface is less than the height of the openings at the opposite ends of the guide passageway.

13. The casing as recited in claim 10, wherein the actuator further comprises:

a first actuator retention barb extending from the first stabilization leg away from the first slot at a position remote from the proximal end of the footing; and a second actuator retention barb extending from the second stabilization leg away from the second slot at a position remote from the proximal end of the footing.

14. The casing as recited in claim 9, wherein lateral displacement of the actuator within the guide passageway is precluded by the interaction of the outer edges of the first and second stabilization legs with respective interior sides of the mounting bridge.

15. The casing as recited in claim 9, wherein the cover is secured to the base of the casing with mechanical fasteners.

16. The casing as recited in claim 9, wherein the cover is secured to the base of the casing with an adhesive.

17. A latching system for use with a small-form pluggable receptacle of the type having secured at the threshold thereto a resilient catch with a securement recess formed on the side thereof facing the receptacle, the system comprising:

a small-form pluggable casing sized for insertion into the receptacle;

a metallic securement tang upstanding from a lateral surface of the casing at such a position that during insertion of the casing into the receptacle the securement tang urges the catch away from the casing to enter the securement recess, and the securement tang becomes captured in the securement recess by the resilling of the catch toward the casing into a latching position of the catch;

a mounting bridge upstanding from a lateral trigger mount surface on the casing located outside of the receptacle when the securement tang is captured in the securement recess, the trigger mount surface and the interior of the mounting bridge at each edge thereof defining openings at opposite ends of a guide passageway beneath the mounting bridge oriented toward the securement tang; and an actuator slidably disposed in the guide passageway and being capable of engaging in reciprocating movement in alignment with the securement tang, the actuator comprising:

(i) an actuator body substantially filling the guide passageway during movement of the actuator, the actuator body comprising:

(A) a footing having a proximal end and a distal end; and (B) a resilient stabilization leg secured at an end thereof to a side of the proximal end of the footing, the stabilization leg extending generally parallel to the footing, thereby to define between the footing and the stabilization leg a slot with an open end adjacent the distal end of the footing;

(ii) an actuator retention barb extending from the stabilization leg away from the slot at a position remote from the proximal end of the footing; and (iii) a catch deflector projecting from the distal end of the footing toward the securement tang in alignment with the guide passageway, the catch deflector having a free end remote from the footing so configured as to release the securement tang from the securement recess by displacing the catch away from the casing and out of the latching position, when the actuator is caused by an operator to move toward the securement tang into a releasing position of the actuator.

18. The system as recited in claim 17, wherein the casing is integrally formed with the securement tang.

19. The system as recited in claim 17, wherein the casing is insert molded about the securement tang.

20. The system as recited in claim 17, wherein the mounting bridge is integrally formed with the trigger mount surface in an insert molding process, and in the insert molding process a window is formed through the trigger mount surface beneath the span of the mounting bridge using a shut-off-front-and-back molding plug.

* * * * *